US006975339B2

(12) United States Patent
Hall et al.

(10) Patent No.: US 6,975,339 B2
(45) Date of Patent: Dec. 13, 2005

(54) ELECTROSTATIC-WRITING MECHANISM HAVING MICROMIRRORS TO SELECTIVELY DIRECT LIGHT ONTO OPTICAL PHOTOCONDUCTOR MECHANISM

(75) Inventors: Jeffrey D. Hall, Meridian, ID (US); Tim M. Hoberock, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/449,996

(22) Filed: May 31, 2003

(65) Prior Publication Data

US 2004/0239748 A1 Dec. 2, 2004

(51) Int. Cl.[7] ..... B41J 2/385; G03G 13/04
(52) U.S. Cl. ..... 347/135; 347/255
(58) Field of Search ..... 347/134, 243, 347/239, 255, 135, 224

(56) References Cited

U.S. PATENT DOCUMENTS 5,453,778 A * 9/1995 Venkateswar et al. ..... 347/239
5,461,411 A * 10/1995 Florence et al. ..... 347/240
5,877,800 A * 3/1999 Robinson et al. ..... 347/255
5,933,682 A * 8/1999 Rushing ..... 399/51
6,069,727 A 5/2000 Cho et al.
6,188,426 B1 * 2/2001 Nakamura ..... 347/239
6,480,218 B2 11/2002 Kurematsu
2001/0015750 A1 * 8/2001 Enomoto et al. ..... 347/234
2001/0017702 A1 8/2001 Kito
2002/0051141 A1 5/2002 Kito

OTHER PUBLICATIONS

"How Laser Printers Work," web site www.howstuffworks.com, 1998-2003.
"Okidata LED Versus Laser Printers," web site www.compurdirect.net, date unknown. "Input-Output/Las r Print rs," web sit www.pctechguide.com, Jan 17, 2002.

* cited by examiner

*Primary Examiner*—Ren Yan
*Assistant Examiner*—Leo T. Hinze

(57) ABSTRACT

An electrostatic-writing mechanism for an image-formation device having an optical photoconductor (OPC) mechanism of one embodiment of the invention is disclosed that includes a light source and an array of micromirror devices. The light source is to emit light. The array of micromirror devices is to selectively direct the light onto the OPC mechanism in accordance with a portion of an image.

28 Claims, 4 Drawing Sheets

ELECTROSTATIC-WRITING MECHANISM HAVING MICROMIRRORS TO SELECTIVELY DIRECT LIGHT ONTO OPTICAL PHOTOCONDUCTOR MECHANISM

BACKGROUND

Since their introduction, printers have become very popular peripherals for computers. One type of printer is the laser printer. In a laser printer, a laser scans an image onto a charged drum, which is coated with toner where the laser scanned the image. The image is developed with the toner, and is transferred to the media. A fuser, generally located in the printer, then fuses the toner permanently to the media. Laser printers, as well as other types of printers, are commonly available in both monochrome models and color models.

The laser-scanning mechanism of a laser printer is quite complex. The mechanism usually includes an elaborate combination of rotating mirrors and lenses to scan the laser from one end of the drum to the other end of the drum. These parts may occupy a large amount of space within the printer, increasing the printer's size and/or footprint. Furthermore, the parts may have to be shielded against unwanted vibrations, requiring additional design expense and also raising manufacturing costs.

The rotating mirror may have to rotate in excess of 30,000 revolutions-per-minute for the printer to achieve high-speed printing, since the drum is discharged serially. To obtain high image quality, the scanning mechanism may have to be manufactured to a high degree of tolerance, which also increases manufacturing costs. If the laser-scanning mechanism fails, the entire printer fails, since the drum cannot then be properly discharged. Even if the scanning mechanism does not catastrophically fail, improper operation or improper alignment of the mechanism can cause image quality to suffer.

SUMMARY OF THE INVENTION

An electrostatic-writing mechanism for an image-formation device having an optical photoconductor (OPC) mechanism of one embodiment of the invention includes a light source and an array of micromirror devices. The light source is to emit light. The array of micromirror devices is to selectively direct the light onto the OPC mechanism in accordance with a portion of an image.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the embodiments of the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Example Image-Formation Device

Figure 1:
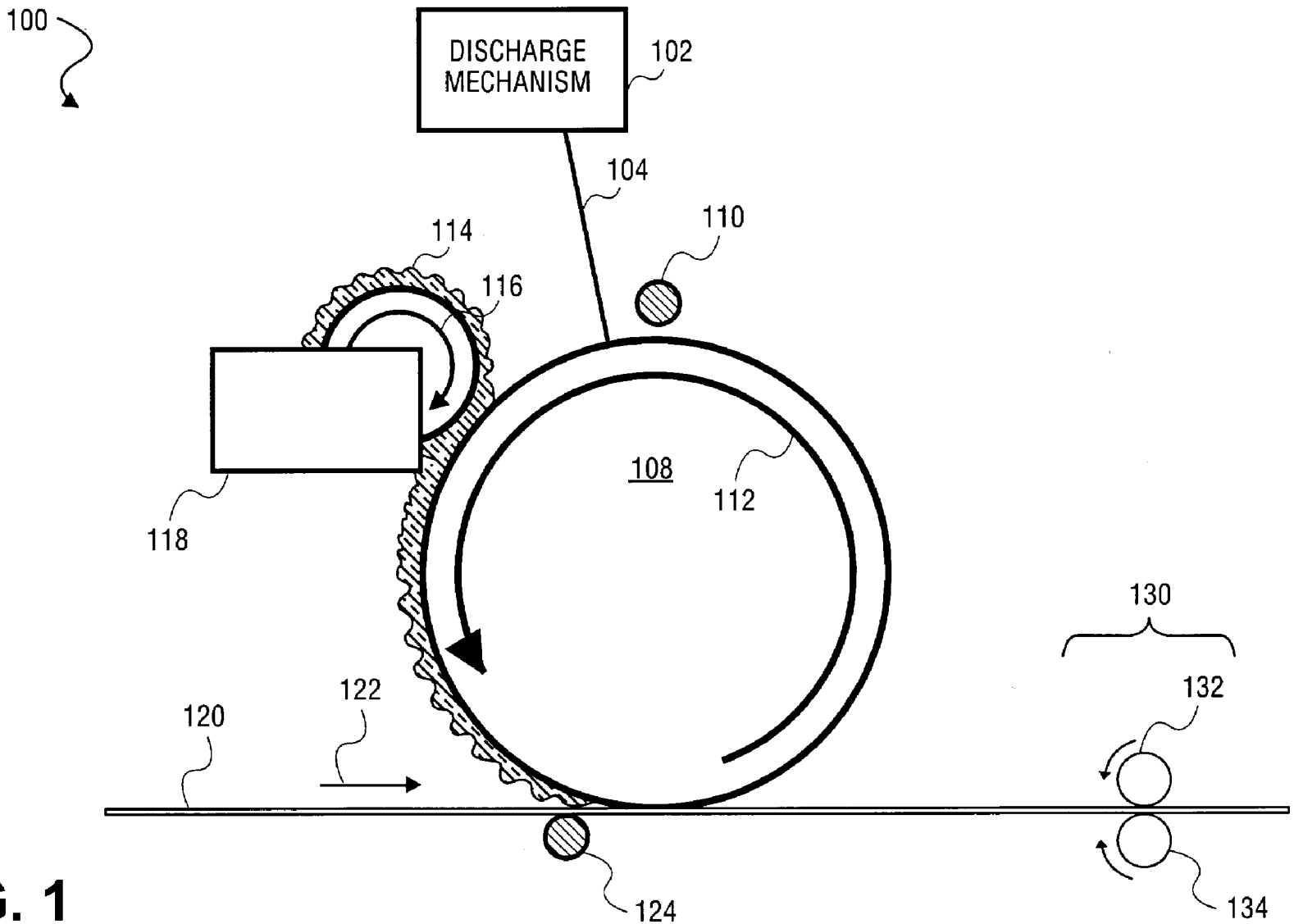
FIG. 1 is a diagram of an example image-formation device having an optical photoconductor (OPC) mechanism, in conjunction with which embodiments of the invention may be implemented.

FIG. 1 shows a representative image-formation device 100 in accordance with which embodiments of the invention can be implemented. The device 100 is a device that forms images on media, and specifically includes an optical photoconductor (OPC) mechanism 108. The OPC mechanism 108 is made from a photoconductive material that is discharged by light photons. The OPC mechanism 108 may also be referred to and/or may include a photoreceptor drum, an image drum, and/or a photoreceptor drum assembly. Further, in one embodiment, a photoconductor belt is employed, and is included within the OPC mechanism 108. Initially, the OPC mechanism 108 is given a total charge via a charged corona wire 110, which is a wire with an electrical current running through it. Alternatively, a charge roller can be used instead of the corona wire 110. The charged corona wire 110, or the charge roller, is more generally referred to as a pre-charging mechanism to pre-charge the OPC mechanism 108.

As the pre-charged OPC mechanism 108 revolves, the discharge mechanism 102 emits light 104 onto the surface of the OPC mechanism 108 to discharge certain spots of the OPC mechanism 108 in accordance with a print job, such as a portion of an image to be formed onto media. In this way, the discharge mechanism 102 draws the print job to be printed as a pattern of electrical charges, which can be referred to as an electrostatic image. The OPC mechanism 108 rotates counter-clockwise for purposes of illustration only, as indicated by the arrow 112. The manner by which the discharge mechanism 102 selectively discharges the OPC mechanism 108 is specifically described in subsequent sections of the detailed description.

After the pattern has been set, the image-formation device 100 coats the OPC mechanism 108 with charged toner, which is typically fine powder. In monochrome printers, black toner is used; in color printers, three primary colors, as well as black, are typically used. The toner also has a charge, so the toner clings to the discharged areas of the OPC mechanism 108, but not to the charged background. The toner is dispensed by a developer roller 114 that rotates in either clockwise or counter-clockwise direction against the OPC mechanism 108, after having rotated through the toner hopper 118 to pick up toner. For purposes of illustration only, the arrow 116 indicates a clockwise direction of rotation for the roller 114. The developer roller 114 is more generally referred to as a toner-application mechanism to apply toner onto areas of the OPC mechanism 108 that the discharge mechanism 102 has discharged.

With the powder pattern affixed, the OPC mechanism 108 rolls over a sheet of media 120, which moves in the direction indicated by the arrow 122. Before the media 120 rolls under the OPC mechanism 108, it is given a charge by the transfer corona wire 124 or by a transfer charge roller. The force upon the toner resulting from by this charge is stronger than the force holding the toner to the OPC mechanism 108, so the media 120 pulls the powder away from the OPC mechanism 108. The transfer corona wire 124, or the transfer charge roller, is more generally referred to as a toner-transfer mechanism to transfer toner from the OPC mechanism 108 onto the media 120.

The image-formation device 100 finally passes the media 120 through the fuser 130, which in the device 100 specifically is a pair of heated rollers 132 and 134 that move in opposite direction. Alternatively, only one of the rollers 132 and 134 is heated. Alternatively, the rollers could be driven or non-driven films. As the media 120 passes through these rollers 132 and 134, the loose toner powder melts, and flows onto the surface of the media 120. The fuser 130 rolls the media 120 to an output tray (not shown in FIG. 1), providing a printed image. The fuser 130 also heats up the media 120 itself, such that the media 120 is warm when it leaves the device 100. The fuser 130 is more generally a fusing mechanism to fuse the toner onto the media 120. After depositing the toner on the media 120, the OPC mechanism 108 passes a cleaning station (not shown in FIG. 1), which cleans the surface of the OPC mechanism 108 and prepares it for repeating the process that has been described.

The image-formation device 100 has been described as the OPC mechanism 108 being pre-charged and then selectively discharged in accordance with an image to be formed onto the media 120. However, alternatively, the OPC mechanism 108 can be initially uncharged, and then selectively charged in accordance with the image to be formed onto the media 120. Both cases generally are referred to as the OPC mechanism 108 being electrostatically written in accordance with the image to be formed onto the media 120, where electrostatic writing is inclusive of selectively discharging the pre-charged OPC mechanism 108 and selectively charging the uncharged OPC mechanism 108.

Discharge Mechanism Having Micromirror Devices

Figure 2:
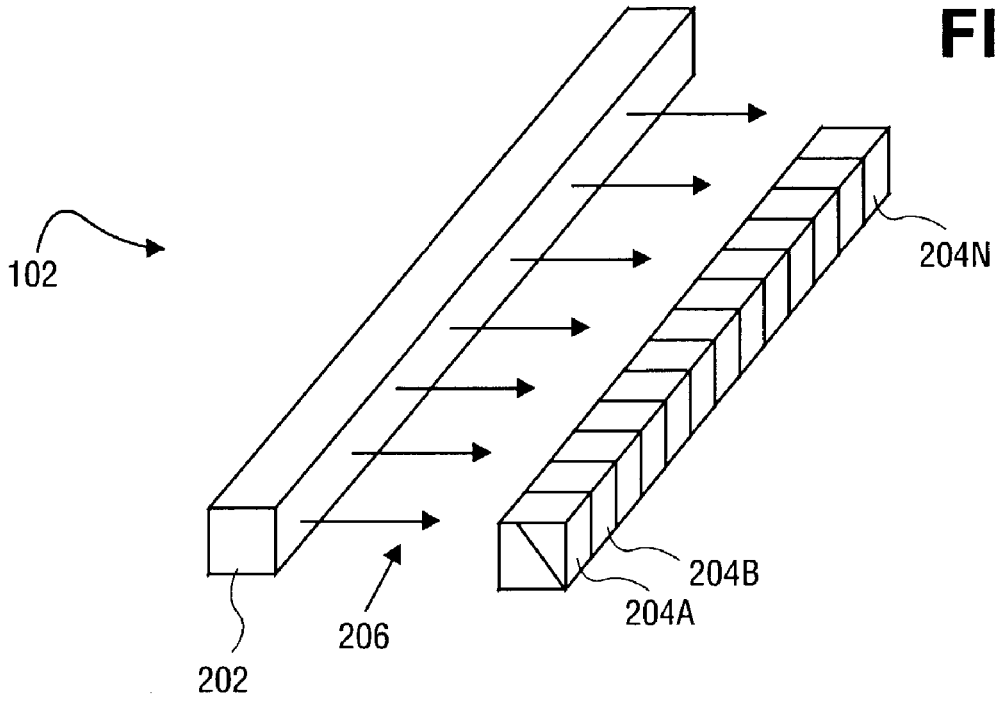
FIG. 2 is a diagram of a discharge mechanism having micromirror devices with which to selectively discharge an OPC mechanism of an image-formation device, according to an embodiment of the invention.

FIG. 2 shows the discharge mechanism 102 in detail, according to an embodiment of the invention. The discharge mechanism 102 includes a light source 202 and an array of micromirror devices 204A, 204B, . . . , 204N, collectively referred to as the micromirror devices 204. The discharge mechanism 102 selectively reflects light onto the pre-charged OPC mechanism 108 of FIG. 1 on a line-by-line basis, in accordance with an image to be formed onto the media 120 of FIG. 1, to selectively discharge the pre-charged OPC mechanism 108 in accordance with this image. Selectively discharging the OPC mechanism 108 on a line-by-line, or parallel, basis, instead of serially one pixel at a time, provides for faster discharging of the OPC mechanism 108, and hence potentially increased performance of image formation on the media 120. Furthermore, the discharge mechanism 102 is more generally an electrostatic-writing mechanism, such that in an alternative embodiment of the invention, the mechanism 102 charges the uncharged OPC mechanism 108, instead of discharging the pre-charged OPC mechanism 108, and is referred to as a charge mechanism.

The light source 202 emits light 206 over the array of the micromirror devices 204 when the OPC mechanism 108 is pre-charged and ready to be selectively discharged. The light 206 is preferably substantially uniform over the entire array of the micromirror devices 204. The light source 202 may be a light bulb, a wide-field laser, an array of light-emitting diodes (LED's), or another type of light source.

The array of the micromirror devices 204 is preferably a linear array of the micromirror devices 204. The micromirror devices 204 selectively direct the light 206 emitted by the light source 202 onto the pre-charged OPC mechanism 108 to selectively discharge the pre-charged OPC mechanism 108, in accordance with a current portion of an image that is thus preferably a current line of the image. Each of the micromirror devices 204 therefore preferably corresponds to a pixel of the current line of the image. The micromirror devices 204 may be piezoelectric micromirror devices, digital micromirror devices (DMD's), spatial light modulators (SLM's), and/or other types of micromirror devices.

Figure 3:
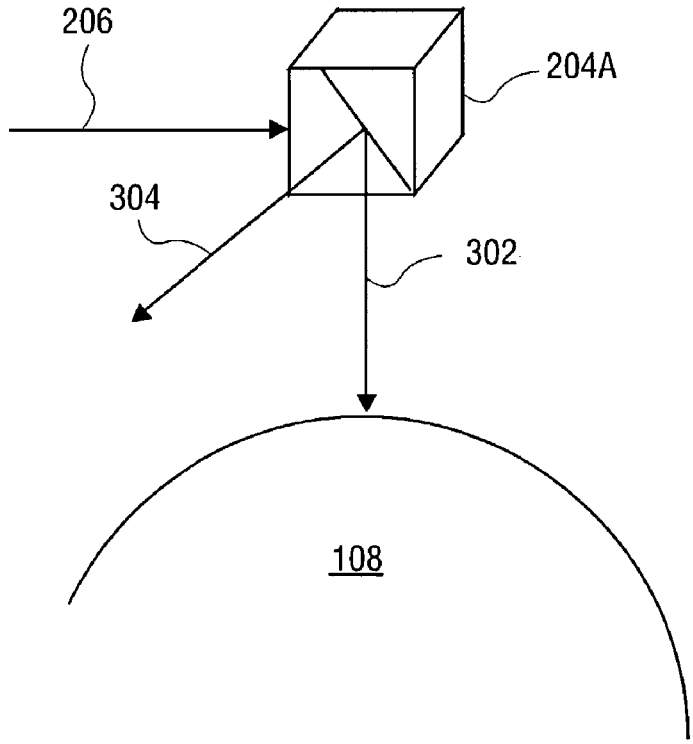
FIG. 3 is a diagram depicting how an individual micromirror of the discharge mechanism of FIG. 2 can be controlled to either direct light towards a corresponding spot on an OPC mechanism, or away from the OPC mechanism, according to an embodiment of the invention.

FIG. 3 shows the manner of operation of the micromirror device 204A, according to an embodiment of the invention, as representative of all the micromirror devices 204. That is, the description of the micromirror device 204A in relation to FIG. 3 is representative of how each of the micromirror devices 204 operates. The micromirror device 204A is individually controllable either to direct, or reflect, the incoming light 206 to a corresponding spot on the OPC mechanism 108, as indicated as the reflected light 302, or to direct, or reflect, the incoming light 206 away from the OPC mechanism 108, as indicated by the reflected light 304.

If a current line of the image to be formed onto the media 120 of FIG. 1 has an on, or dark, pixel to which the micromirror device 204A corresponds, then the device 204A is independently controlled to reflect the incoming light 206 onto its corresponding spot on the OPC mechanism 108 that also corresponds to the pixel. This discharges the OPC mechanism 108 at this spot, such that toner will subsequently be picked up by the OPC mechanism 208 at this spot, and ultimately transferred and fused to the media 120. By comparison, if the current line of the image to be formed onto the media 120 has an off, or light, pixel to which the micromirror device 204A corresponds, then the device 204A is instead independently controlled to reflect the incoming light 206 away from the OPC mechanism 108 that also corresponds to the pixel. This means that the pre-charge on the OPC mechanism 108 is not discharged at this spot, such that toner will not be subsequently picked up by the OPC mechanism 108 at this spot.

For the linear array of the micromirror devices 204 as a whole, this process occurs on a line-by-line basis, for each line of the image to be formed onto the media 120. The micromirror devices 204 are individually controlled at the same time to either reflect the light 206 towards their corresponding spots on the OPC mechanism 108, or away from the OPC mechanism 108. Because the micromirror devices 204 are controlled at the same time, the OPC mechanism 108 is said to be discharged a line at a time, or on a line-by-line basis. Because the micromirror devices 204 are individually controlled, such that each device can either reflect the light 206 to discharge its corresponding spot on the OPC mechanism 108 or reflect the light 206 away from the OPC mechanism 108 to not discharge this spot, the OPC mechanism 108 is said to be discharged selectively.

Figure 4:
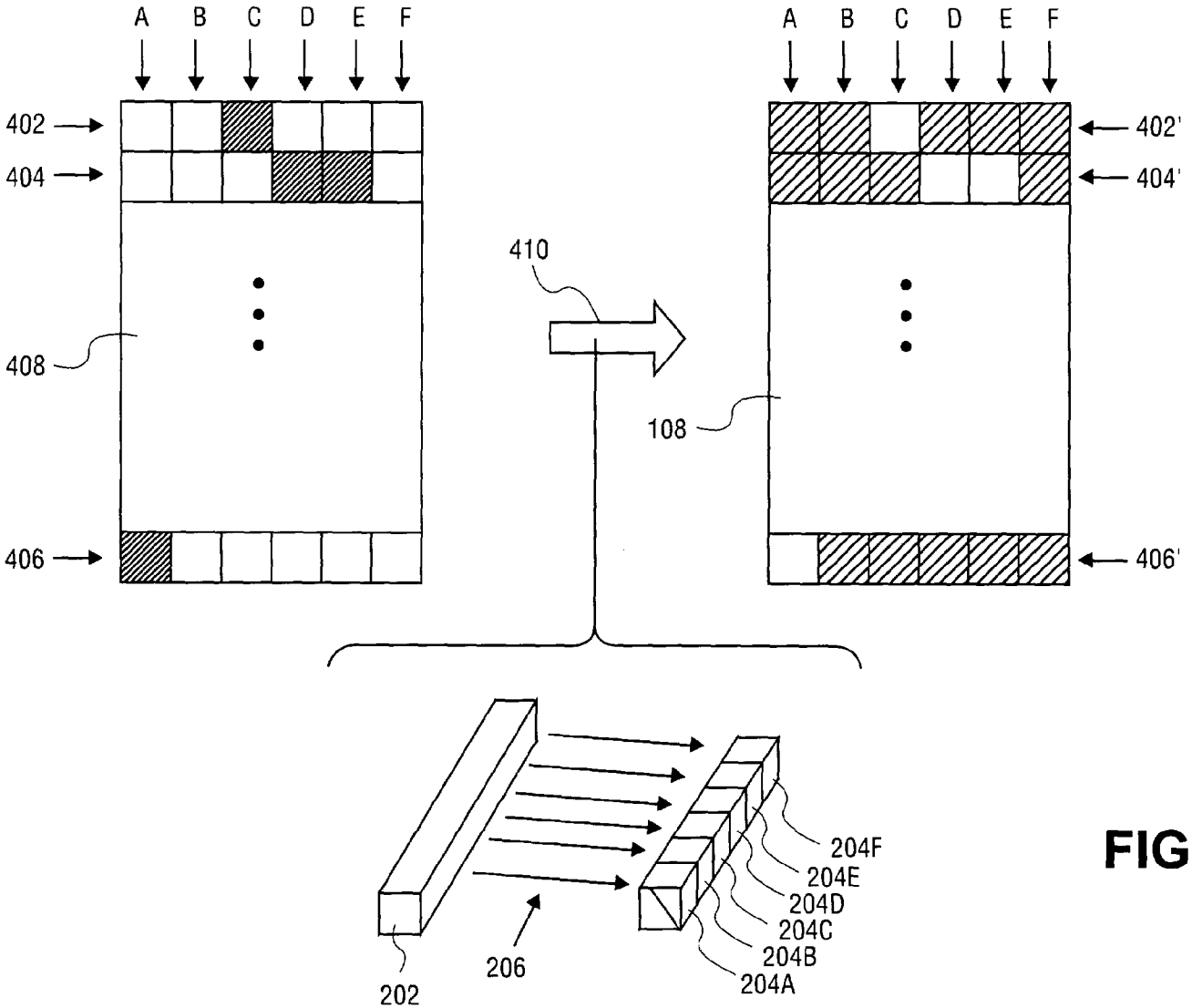
FIG. 4 is a diagram of a rudimentary example depicting how the discharge mechanism of FIG. 2 is able to selectively discharge an OPC mechanism on a line-by-line basis, according to an embodiment of the invention.

FIG. 4 depicts a rudimentary, simplified example of the selective discharge of the OPC mechanism 108 on a line-by-line basis in accordance with an image to be formed onto the media 120, according to an embodiment of the invention. The image 408 is to be formed onto the media 120 of FIG. 1, and has been divided into a number of rows of pixels, including the rows 402, 404, and 406, and a number of columns of pixels, indicated as the columns A, B, C, D, E, and F. In actuality, there may be hundreds or more pixels per inch, such that a resolution of 600 dots-per-inch (dpi), 1200 dpi, or more, is realized. Each pixel of the image 408 is individually indicated by a row and a column. For instance, the third pixel of the row 402 is indicated as the pixel 402C, whereas the second pixel of the row 406 is indicated as the pixel 406B. Dark, or on, pixels of the image 408 are indicated in FIG. 4 by shading, whereas light, or off, pixels of the image 408 are indicated in FIG. 4 by the absence thereof.

The pattern of each row, or line, of the image 408 is correspondingly transferred to the OPC mechanism 108, on a line-by-line basis, by selectively discharging spots on the OPC mechanism 108 that correspond to dark, or on, pixels of the image 408, as indicated by the arrow 410, as the OPC mechanism 108 rotates such that different portions thereof can be affected by the light 206 reflected by the micromirror devices 204. The OPC mechanism 108 thus ultimately has a correspondingly organized electrostatic, or discharge, pattern of the image 408. The surface of the OPC mechanism 108 in FIG. 4 is that which is incident to the light 104 in FIG. 1. This surface of the OPC mechanism 108 is depicted in FIG. 4 as flattened, for the sake of illustrative clarity. However, the surface may actually be a flat surface in the case in which a photoconductor belt is used for OPC mechanism 108.

The OPC mechanism 108 can be conceptually or logically considered to have individual spots that correspond to the pixels of the image 408. These individual spots are likewise organized in columns A, B, C, D, E, and F, and in rows, including the rows 402', 404', and 406'. Each spot is individually indicated by a row and a column. For instance, the third spot of the row 402' is indicated as the spot 402C'. Spots on the OPC mechanism 108 that remain pre-charged, and have not been discharged, are indicated in FIG. 4 by shading, whereas spots on the OPC mechanism 108 that have been discharged are indicated in FIG. 4 by the absence of shading.

The selective discharge of the OPC mechanism 108 on a line-by-line basis is accomplished by individually controlling the micromirror devices 204A, 204B, 204C, 204D, 204E, and 204F, as corresponding to the pixels of the image 408 in the columns A, B, C, D, E, and F, respectively, on a line-by-line basis. The micromirror devices 204A, 204B, 204C, 204D, 204E, and 204F are individually controlled to either reflect the light 206 from the light source 202 towards their corresponding spots of the OPC mechanism 108 in the columns A, B, C, D, E, and F, or away from the OPC mechanism 108, depending on whether the pixels in a current line, or row, of the image 408 are on or off. The micromirror devices 204A, 204B, 204C, 204D, 204E, and 204F are controlled substantially at the same time for each line, or row, of the image 408, such that the OPC mechanism 108 is selectively discharged on a line-by-line basis.

For instance, to impart the pattern of the row 402 of the image 408 as the logical row 402' on the OPC mechanism 108, the micromirror device 204C is controlled to reflect the light 206 onto its corresponding spot 402C' in the row 402' on the OPC mechanism 108, whereas the other devices 204A, 204B, 204D, 204E, and 204F are controlled to reflect the light 206 away from the OPC mechanism 108. As such, the row 402' on the OPC mechanism 108 remains pre-charged at the spots 402A', 402B', 402D', 402E', and 402F', and is discharged at the spot 402C'. The pre-charged spots 402A', 402B', 402D', 402E', and 402F' on the OPC mechanism 108 thus correspond to the off pixels 402A, 402B, 402D, 402E, and 402F of the image 408, whereas the pre-charged spot 402C' corresponds to the on pixel 402C.

The OPC mechanism 108 rotates, or moves, such that the pattern of the row 404 of the image 408 is to be imparted as the logical row 404' on the OPC mechanism 108 by the micromirror devices 204. The micromirror devices 204D and 204E are controlled to reflect the light 206 onto their corresponding spots 404D' and 404E' in the row 404' on the OPC mechanism 108, whereas the other devices 204A, 204B, 204C, and 204F are controlled to reflect the light 206 away from the OPC mechanism 108. As such, the row 404' on the OPC mechanism 108 remains pre-charged at the spots 404A', 404B', 404C', and 404F', and is discharged at the spots 404D' and 404E'. The pre-charged spots 404A', 404B', 404C', and 404F' on the OPC mechanism 108 correspond to the off pixels 404A, 404B, 404C, and 404F of the image 408, whereas the pre-charged spots 404D' and 404E' correspond to the on pixels 404D and 404E.

As a final example, once the OPC mechanism 108 has rotated, or moved, such that the pattern of the row 406 of the image 408 is to be imparted as the logical row 406' of the OPC mechanism 108, the micromirror device 204A is controlled to reflect the light 206 on its corresponding spot 406' in the row 406' on the OPC mechanism 108. The other devices 204B, 204C, 204D, 204E, and 204F are conversely controlled to reflect the light 206 away from the OPC mechanism 108. The row 406' on the OPC mechanism 108 remains pre-charged at the spots 406B', 406C', 406D', 406E', and 406F', and is discharged at the spot 406A'. The pre-charged spots 406B', 406C', 406D', 406E', and 406F' on the OPC mechanism 108 correspond to the off pixels 406B, 406C, 406D, 406E, and 406F of the image 408, whereas the pre-charged spot 406A' corresponds to the on pixel 406A.

Method

Figure 5:
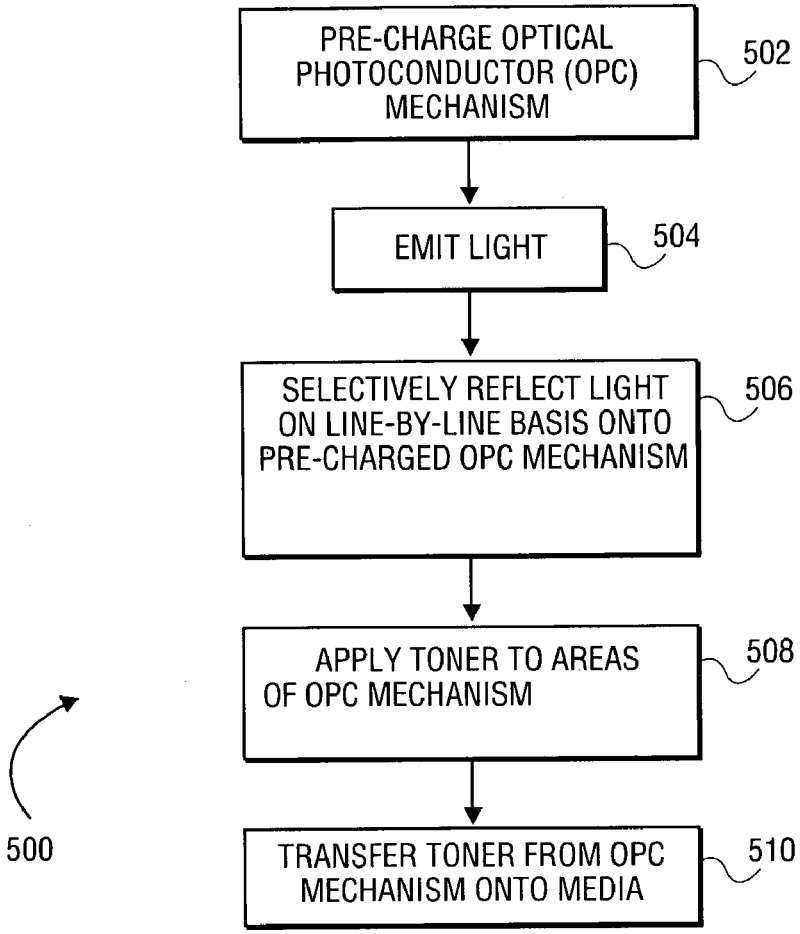
FIG. 5 is a flowchart of a method for forming an image on media by selectively reflecting light onto an OPC mechanism to selectively discharge the OPC mechanism, on a line-by-line basis, according to an embodiment of the invention.

FIG. 5 shows a method 500, according to an embodiment of the invention. The method 500 may be performed by the discharge mechanism 102 and/or the image-formation device 100 that have been described in the preceding sections of the detailed description. At least some parts of the method 500 are performed for each line of an image to be formed onto media, on a line-by-line basis. An optical photoconductor (OPC) mechanism is initially and optionally pre-charged (502), and a light source emits light (504). The light is selectively reflected on a line-by-line basis onto the OPC mechanism in accordance with the image to be formed onto the media, to selectively discharge the OPC mechanism in accordance with this image in the case where the OPC mechanism has been pre-charged, or to otherwise selectively charge the OPC mechanism (506). Toner is applied to areas, or spots, of the OPC mechanism that have been selectively discharged or charged (508), and the toner is transferred from the OPC mechanism onto the media (510).

Figure 6:
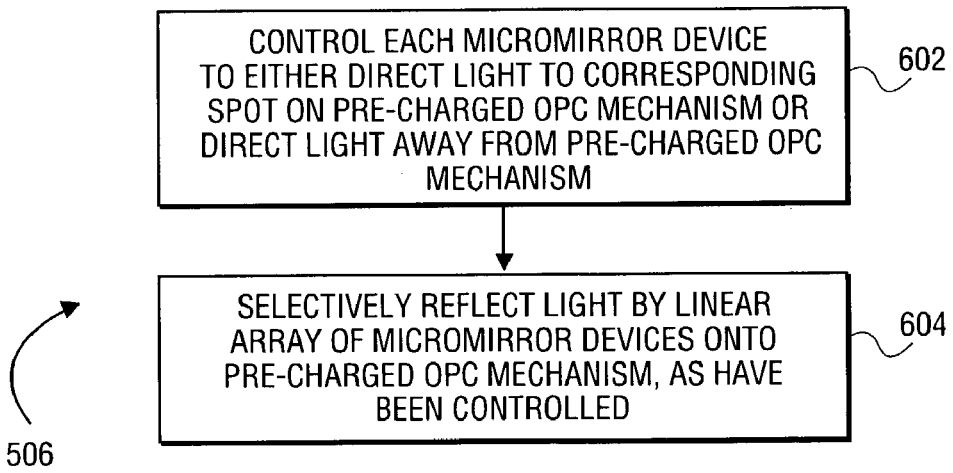
FIG. 6 is a flowchart of a method for selectively reflecting light onto an OPC mechanism to selectively discharge the OPC mechanism by using micromirror devices, according to an embodiment of the invention.

FIG. 6 shows in detail how 506 of the method 500 of FIG. 5 can be performed, according to a specific embodiment of the invention. The light emitted in 504 of the method 500 is specifically emitted substantially uniformly over a linear array of micromirror devices. Each micromirror device is then individually controlled either to direct light to a corresponding spot on the pre-charged OPC mechanism, or to direct light away from the pre-charged OPC mechanism, in accordance with a corresponding pixel of a current line of the image to be formed onto the media (602). Therefore, the linear array of micromirror devices, as have been controlled, as a whole selectively reflects the light onto the pre-charged OPC mechanism, on a line-by-line basis (604).

CONCLUSION

It is noted that, although specific embodiments have been illustrated and described herein, it will be appreciated by those of ordinary skill in the art that any arrangement is calculated to achieve the same purpose may be substituted for the specific embodiments shown. The image-formation device that has been described may be a printing device for use with a computer, for instance, a facsimile device, a photocopying device, or a device that has more than one such functionality. Embodiments of the invention are amenable to color image-formation devices as well as black-and-white image-formation devices.

In addition, embodiments of the invention have been substantially described in relation to an array of micromirror devices that is a linear array, such that a line of pixels of an image to be formed on media is able to be transferred to the OPC mechanism at a single time. In other embodiments, however, the array may be more than one pixel in height, such that a number of lines of pixels of an image to be formed on media are able to be transferred to the OPC mechanism at a single time. That is, the array may be an n pixel-by-m pixel array, where each of n and m is greater than one, instead of a 1 pixel-by-m pixel array. Thus, n lines of the image are electrostatically transferred to the OPC mechanism at one time.

Furthermore, whereas embodiments of the invention have been substantially described to the discharging of a pre-charged optical photoconductor (OPC) mechanism, other embodiments of the invention are also applicable to charging an uncharged OPC mechanism. Such other embodiments of the invention operate in the same way as the discharging embodiment does, except that the OPC mechanism does not need to be pre-charged. The OPC mechanism is thus charged, instead of discharged, in accordance with an image to be formed on media. This application is thus intended to cover any adaptations or variations of the present invention. Therefore, it is manifestly intended that this invention be limited only by the claims and equivalents thereof.

We claim:

1. An electrostatic-writing mechanism for an optical photoconductor (OPC) mechanism, comprising:

a light source to emit light; and, an one-row linear array of micromirror devices to selectively direct the light onto the OPC mechanism in accordance with a portion of an image, each of a plurality of rows of the image having a plurality of pixels, each pixel corresponding to one micromirror device of the one-row linear array of micromirror devices, such that the pixel has the light directed in accordance therewith by at most the one micromirror device, wherein the micromirror devices of the array are individually controlled in parallel at the same time.

2. The electrostatic-writing mechanism of claim 1, wherein the array of micromirror devices selectively direct the light emitted by the light source onto the OPC mechanism to selectively discharge the OPC mechanism, the OPC mechanism being pre-charged, such that the electrostatic-writing mechanism is a discharge mechanism.

3. The electrostatic-writing mechanism of claim 1, wherein the array of micromirror devices selectively direct the light emitted by the fight source onto the OPC mechanism to selectively charge the OPC mechanism, the OPC mechanism being uncharged, such that the electrostatic-writing mechanism is a charge mechanism.

4. The electrostatic-writing mechanism of claim 1, wherein the array of micromirror devices comprises an array of digital micromirror devices (DMD's).

5. The electrostatic-writing mechanism of claim 1, wherein the light source emits light over the array of micromirror devices when the OPC mechanism is to be selectively electrostatically written.

6. The electrostatic-writing mechanism of claim 1, wherein the light source comprises one of a light bulb, a wide-field laser, and a plurality of light-emitting diodes (LED's).

7. The electrostatic-writing mechanism of claim 1, wherein each of the array of micromirror devices is individually controllable to one of direct light to a corresponding spot onto the OPC mechanism and direct light away from the OPC mechanism, in accordance with a pixel of the portion of the image.

8. The electrostatic-writing mechanism of claim 1, wherein the array of micromirror devices comprises an array of piezoelectric micromirror devices.

9. The electrostatic-writing mechanism of claim 1, wherein the array of micromirror devices comprises a plurality of spatial light modulators (SLM's).

10. An image-formation device comprising:

a pre-charged optical photoconductor (OPC) mechanism;

means for selectively reflecting light on a line-by-line basis onto the pre-charged OPC mechanism to selectively discharge the pre-charged OPC mechanism in accordance with an image to be formed onto media, wherein the means comprises a one-row linear array of elements, each of a plurality of rows of the image having a plurality of pixels, each pixel corresponding to one element of the one-row linear array of elements, such that the pixel has the light directed in accordance therewith by at most the one element, wherein the elements of the array are individually controlled in parallel at the same time.

11. The image-formation device of claim 10, wherein the means comprises a light source to emit the light.

12. The image-formation device of claim 10, wherein the means comprises a linear array of micromirror devices to selectively reflect the light on the line-by-line basis onto the pre-charged OPC mechanism to selectively discharge the pre-charged OPC mechanism.

13. The image-formation device of claim 10, wherein the means comprises a linear array of spatial light modulators (SLM's) to selectively reflect the light on the line-by-line basis onto the pre-charged OPC mechanism to selectively discharge the pre-charged OPC mechanism.

14. The image-formation device of claim 10, wherein the device is at least one of a printing device, a facsimile device, and a photocopying device.

15. A method comprising:

emitting light;

selectively reflecting the light on a line-by-line basis onto an optical photoconductor (OPC) mechanism in accordance with an image to be formed onto media by each of a one-row linear array of reflection elements selectively reflecting the light, each of a plurality of rows of the image having a plurality of pixels, each pixel corresponding to one element of the one-row linear array of reflection elements, such that the pixel has the light directed in accordance therewith by at most the one reflection element;

applying toner to areas of the OPC mechanism that have been selectively discharged; and, transferring the toner from the OPC mechanism onto the media, wherein the reflection elements of the array are individually controlled in parallel at the same time.

16. The method of claim 15, wherein selectively reflecting the light on the line-by-line basis onto the pre-charged OPC mechanism in accordance with the image to be formed onto the media comprises:

controlling each micromirror device of the linear array of micromirror devices to one of direct light to the pre-charged OPC mechanism and direct light away from the pre-charged OPC mechanism, in accordance with a corresponding pixel of the image; and, selectively reflecting the light by the linear array of micromirror devices onto the pre-charged OPC mechanism.

17. An image-formation device comprising:

a pre-charged optical photoconductor (OPC) mechanism; and, a discharge mechanism to selectively reflect light on a line-by-line basis onto the pre-charged OPC mechanism to selectively discharge the pre-charged OPC mechanism in accordance with an image to be formed onto media, wherein the discharge mechanism comprises a one-row linear array of discharge elements, each of a plurality of rows of the image having a plurality of pixels, each pixel corresponding to one discharge element of the one-row linear discharge elements, such that the pixel has the light directed in accordance therewith by at most the one discharge element, wherein the discharge elements of the array are individually controlled in parallel at the same time.

18. The image-formation device of claim 17, further comprising:

a pre-charging mechanism to pre-charge the pre-charged OPC mechanism;

a toner-application mechanism to apply toner to areas of the OPC mechanism that the discharge mechanism has selectively discharged;

a toner-transfer mechanism to transfer the toner from the OPC mechanism onto the media; and, a fusing mechanism to fuse the toner onto the media.

19. The image-formation device of claim 17, wherein the pre-charged OPC mechanism is at least one of a photoreceptor drum, an image drum, a photoreceptor drum assembly, and a photoconductor belt.

20. The image-formation device of claim 17, wherein the discharge mechanism comprises a light source to emit the light.

21. The image-formation device of claim 17, wherein the discharge mechanism comprises a linear array of micromirror devices to selectively reflect the light on the line-by-line basis onto the pre-charged OPC mechanism to selectively discharge the pre-charged OPC mechanism.

22. The image-formation device of claim 21, wherein each micromirror device of the linear array of micromirror devices is individually controllable to one of direct light to a corresponding spot onto the pre-charged OPC mechanism and direct light away from the pre-charged OPC mechanism, in accordance with a pixel of a line of the image.

23. The image-formation device of claim 17, wherein the discharge mechanism comprises a linear array of spatial light modulators,(SLM's) to selectively reflect the light on the line-by-line basis onto the pre-charged OPC mechanism to selectively discharge the pre-charged OPC mechanism.

24. The image-formation device of claim 17, wherein the device is at least one of: a printing device, a facsimile device, and a photocopying device.

25. A discharge mechanism for an image-formation device having a pre-charged optical photoconductor (OPC) mechanism, comprising:

means for emitting light; and, means for selectively directing the light onto the pre-charged OPC mechanism to selectively discharge the pre-charged OPC mechanism in accordance with a portion of an image, wherein the means comprises a one-row linear array of elements, each of a plurality of rows of the image having a plurality of pixels, each pixel corresponding to one element of the one-row linear array of elements, such that the pixel has the light directed in accordance therewith by at most the one element, wherein the elements of the array are individually controlled in parallel at the same time.

26. The discharge mechanism of claim 25, wherein the means for emitting light comprises one of a light bulb, a wide-field laser, and a plurality of light-emitting diodes (LED's).

27. The discharge mechanism of claim 25, wherein the means for selectively directing the light onto the pre-charged OPC mechanism comprises a linear array of micromirror devices.

28. The discharge mechanism of claim 25, wherein the means for selectively directing the light onto the pre-charged OPC mechanism comprises a linear array of spatial light modulators (SLM's).

* * * * *